US006549741B2

(12) United States Patent
Miura

(10) Patent No.: US 6,549,741 B2
(45) Date of Patent: Apr. 15, 2003

(54) CARRYING APPARATUS AND IMAGE FORMING APPARATUS

(75) Inventor: Tatsuyuki Miura, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,735

(22) Filed: Aug. 7, 2001

(65) Prior Publication Data

US 2003/0031480 A1 Feb. 13, 2003

(51) Int. Cl.[7] ..... G03G 21/00; G03G 15/00
(52) U.S. Cl. ..... 399/124; 399/401
(58) Field of Search ..... 399/16, 18, 19, 399/20, 21, 23, 79, 81, 124, 381, 388, 397, 401

(56) References Cited

U.S. PATENT DOCUMENTS 4,671,644 A * 6/1987 Sumida et al. ..... 399/124
4,835,567 A * 5/1989 Ogata ..... 399/124
5,157,448 A * 10/1992 Lang ..... 399/23
5,450,170 A * 9/1995 Kimizuka et al. ..... 399/18
6,089,560 A * 7/2000 Fujiwara ..... 271/4.1
6,125,251 A * 9/2000 Shiraishi et al. ..... 399/124
6,134,404 A * 10/2000 Iwai et al. ..... 399/124 X
6,185,381 B1 * 2/2001 Nakahara et al. ..... 399/21

FOREIGN PATENT DOCUMENTS

JP 5088422 4/1993

* cited by examiner

*Primary Examiner*—Sandra Brase
(74) *Attorney, Agent, or Firm*—Foley & Lardner

(57) ABSTRACT

The carrying apparatus comprises a carrying device for carrying an object to be carried, along a carrying route, a control device for temporarily stopping and holding the object carried by the carrying device, on the carrying route, if necessary, an open/close door provided in the carrying device, for opening/closing the carrying route, and a limiter device for limiting opening of the open/close door, based on detection of the object by the detection device.

10 Claims, 8 Drawing Sheets

CARRYING APPARATUS AND IMAGE FORMING APPARATUS

BACKGROUND OF THE INVENTION

The present invention relates to a carrying apparatus for conveying a paper sheet and an image forming apparatus which are comprised, for example, in an electrophotographic copying machine.

In many electrophotographic copying machines, images can be formed on both surfaces of a paper sheet. To form images on both surfaces in this kind of copying machine, a paper sheet is supplied from a paper sheet feed cassette to an image forming section through a paper sheet carrying route (hereinafter simply called ADU), and an image is formed on one surface. The paper sheet on which an image has been formed is then stacked and contained in an intermediate tray. Subsequently, the paper sheet stacked and contained in the intermediate tray is fed again to the image forming section, and an image is then formed on its back surface. Thus, images are formed on both surfaces of a paper sheet which is then fed out onto a sheet discharge tray.

Meanwhile, electrostatic charges have been applied to paper sheets stacked on the intermediate tray, for example, through a transfer process at the image forming section. Therefore, paper sheets easily tend to be fed stuck together due to static electricity, when they are fed again from the intermediate tray.

In addition, since a paper sheet having a surface on which an image has been formed must once be stacked and contained in the intermediate tray, an image cannot be formed sequentially on its back surface. Time loss is therefore caused so that the image forming efficiency is lowered.

To solve the above-described problems that layered paper sheets are fed and the image forming efficiency is lowered, a development has been made in an electrophotographic copying machine which adopts so-called non-stack ADU.

That is, this kind of electrophotographic copying machine carries out continuous image formation on surfaces of a plurality of sheets, excluding the intermediate tray from the ADU. Thereafter, these paper sheets are directly sent to the image forming section, reversed by a reverse carrying means, and an image is formed on the back surface of the paper sheet.

In some cases, the non-stack ADU is used with an accounting device such as a coin controller attached thereto. If data of total 4 pages are double-side-printed on two paper sheets in an electrophotographic copying machine attached with the accounting device, for example, there may be a case that inserted money runs short at the time point when printing on pages 1, 2, and 4 pages.

In this case, the paper sheet on which the third page should be printed should be discharged without carrying out printing or should be kept in the ADU in the apparatus.

Meanwhile, the non-stack ADU is opened/closed in accordance with an operation of opening/closing an open/close door. If a paper sheet jams en route, the open/close door is opened to remove the paper sheet.

However, in a conventional apparatus, the open/close door is kept permanently openable, and there is a case that the door is opened with a paper sheet still in the ADU. In this case, there is a drawback that the paper sheet in the ADU falls drops to the ground and gets dirty.

BRIEF SUMMARY OF THE INVENTION

The present invention has been made in view of the actual situation as described above, and has an object of providing a carrying apparatus and an image forming apparatus in which the carrying route (a reverse carrying route) is inhibited from opening when an object to be carried (an object to which an image should be transferred) is kept on a carrying route (a reverse carrying route).

A carrying apparatus according to the present invention comprises: a carrying device for carrying an object to be carried, along a carrying route; a control device for temporarily stopping and holding the object carried by the carrying device, on the carrying route, if necessary; an open/close door provided in the carrying device, for opening/closing the carrying route; and a limiter device for limiting opening of the open/close door, based on detection of the object by the detection device.

An image forming apparatus according to the present invention comprises: an image forming device for forming an image on an image carrier; a transfer device for transferring the image formed by the image forming device, to an object to which the image should be transferred; a reverse carrying device for carrying the object having a surface to which the image has been transferred, along a reverse carrying route, thereby to reverse and feed the object again to the transfer device, and to transfer an image on another surface of the object; a control device for temporarily stopping and holding the object carried by the reverse carrying device, on the carrying route, if necessary; an open/close door provided in the carrying device, for opening/closing the carrying route; a detection device for detecting the object held on the reverse carrying route; and a limiter device for limiting opening of the open/close door, based on detection of the object by the detection device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Figure 1:
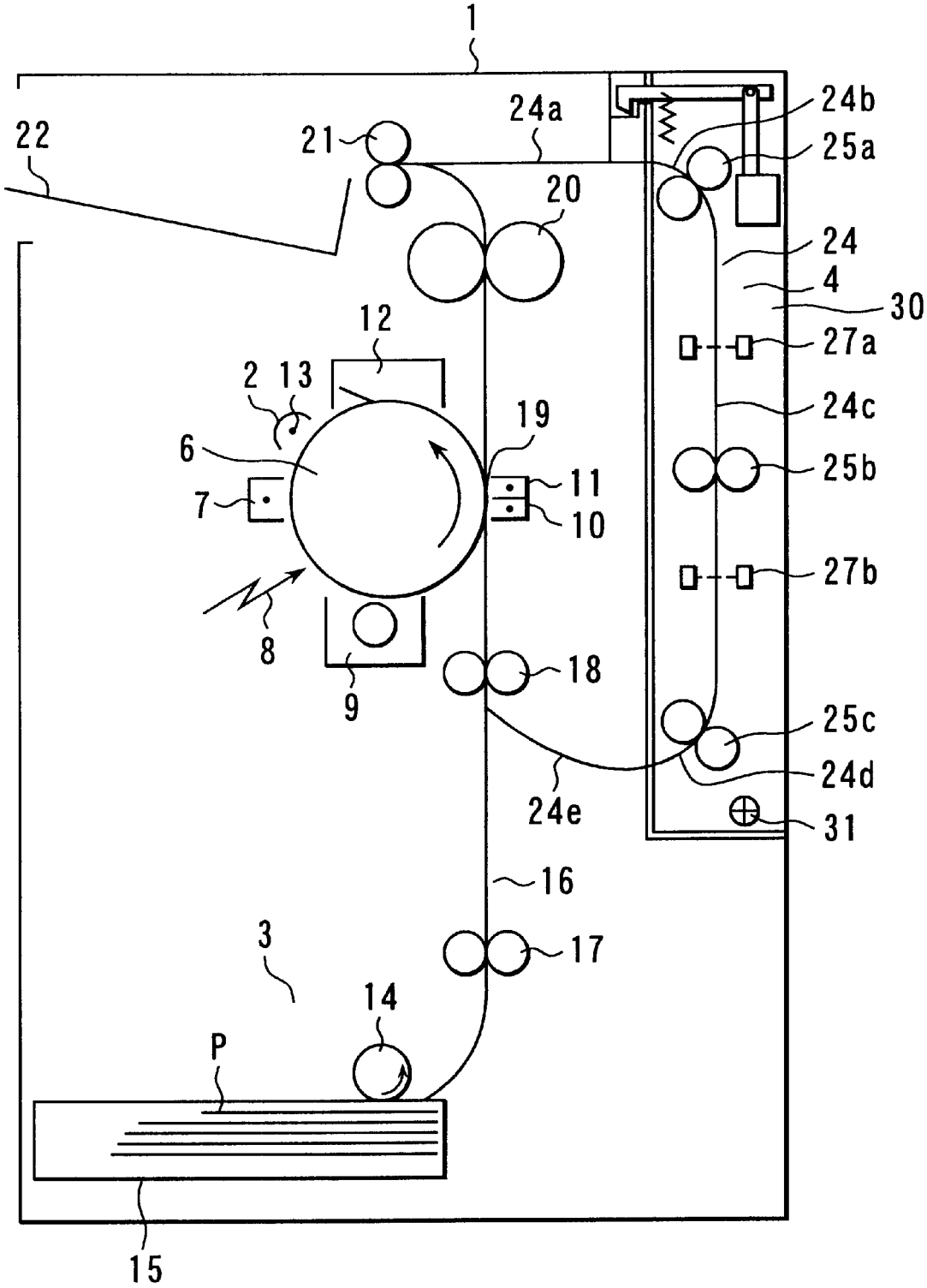
FIG. 1 is a schematic structural view showing an electrophotographic copying machine according to an embodiment of the present invention.
Figure 2:
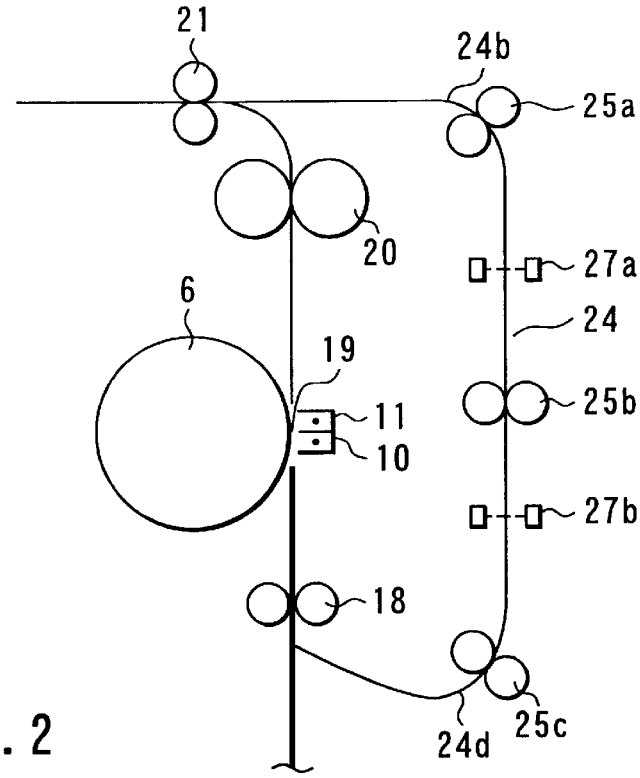
FIG. 2 is a view showing a state in which a paper sheet is being fed to an image transfer section.

In the following, the present invention will be explained with reference to an embodiment shown in the drawings.

FIG. 1 is a structural view showing an electrophotographic machine as an image forming apparatus according to an embodiment of the present invention.

The electrophotographic machine 1 comprises an apparatus body 1. An image forming section 2 for forming an image on a paper sheet as an object to be carried (e.g., a transfer-target material) in an electrostatic photographic method, a sheet feeder 3 for carrying and supplying a paper sheet for the image forming section 2, and a reverse carrying apparatus 4 for reversing the front and back surfaces of the paper sheet and for returning the paper sheet to the sheet feeder 3. Since the reverse carrying apparatus 4 does not comprise an intermediate tray, the apparatus serves as a so-called non-stack ADU.

The image forming section 2 comprises rotatably a photosensitive drum 6 as an image carrier. Provided in the peripheral part of the photosensitive drum 6 are members for executing a so-called electrostatic photographic process by means of a process CPU (not shown).

More specifically, the photosensitive drum 6 is constructed by an application type OPC charged in the minus polarity, and this photosensitive drum 6 includes a conductive base member and a photosensitive layer covering the surface of the conductive base member. The photosensitive layer has a film thickness of 15 to 30 $\mu$m and a dielectric constant of 2.0 to 5.0. The conductive base member of the photosensitive drum 6 is grounded.

Provided in the peripheral part of the photo-sensitive drum 6 along the rotating direction thereof are a charger 7, an optical scanning system (not shown) for emitting imaging light 8, a developing device 9, a transfer device 10, a separator 11, a cleaning device 12, and a discharger 13.

The sheet feeder 3 includes a sheet feed cassette 15 and a main carrying route 16 for carrying a paper sheet supplied from the sheet feed cassette 15 to the upside. Paper sheets P are contained in the sheet feed cassette 15, and are fed one after another by rotation of the sheet feed roller 14.

The main carrying route 16 is provided along the vertical direction. Paired carrying rollers 17, paired resist rollers 18, an image transfer section 19, paired fixing rollers 20, and paired discharge rollers 21 are provided respectively from the side of the lower part to the side of the upper part on the main carrying route 16. A sheet discharge tray 22 is provided in the side of the paired discharge rollers 21 in which paper sheets are discharged.

The reverse carrying device 4 has a reverse carrying route 24 which connects the sheet discharge side of the paired rollers 20 with the sheet introducing side of the paired resist rollers 18. The reverse carrying route 24 is constructed by a horizontal part 24*a*, a corner part 24*b* in the upper side, a vertical part 24*c*, a corner part 24*d* in the lower side, and a substantial horizontal part 24*e*. The corner part 24*b* in the upper side, the vertical part 24*c*, and the corner part 24*d* in the lower side are respectively provided with pairs of carrying rollers 25*a*, 25*b*, and 25*c*.

Upper and lower detection sensors 27*a* and 27*b* as detection devices for detecting paper sheets P are provided respectively between the paired carrying rollers 25*a* and 25*c* and between the paired carrying rollers 25*b* and 25*c*.

In addition, the reverse carrying device 4 has an open/close door 30 for opening/closing the reverse carrying route 24. The open/close door 30 is rotatably supported, in its lower side, on the apparatus body 1 by a support shaft. A lock device 32 as a limiter device is provided in the upper side of the open/close door 30.

Figure 10:
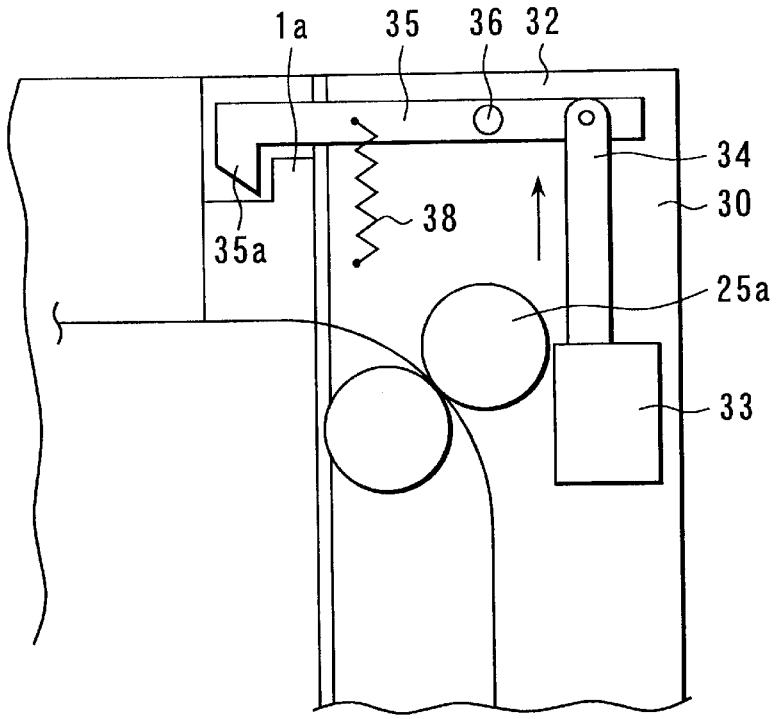
FIG. 10 is an enlarged view showing a lock device for locking an open/close door.

FIG. 10 is an enlarged view of the lock device 32. The lock device 32 is constructed by a solenoid 33, an operation lever 34 which moves up and down in accordance with on and off of the solenoid 33, and a lock lever 35 having a rear end part connected with an upper end part of the operation lever 34. The lock lever 35 has an intermediate part rotatably supported on a support shaft 36 and has a top end part where a hook part 35*a* is formed. The hook part 35*a* of the lock lever 35 is detachably engaged with an engage gap part 1*a* formed on the apparatus body 1. A spring member 38 is connected between the support shaft 36 and the hook part 35*a*, and the lock lever 35 is pressed upward by the spring member 38.

FIG. 10 shows a state where the solenoid 33 is turned on. When the solenoid 33 is turned on, the lock lever 33 is rotated downward about the support shaft 36, against the pressing force of the spring member 38, so that its hook part is engaged with the engaging gap part 1*a* thereby to lock the open/close door 30.

When the solenoid 33 is turned off, the lock lever 35 is pushed upward by the spring member 38, so that its hook part 35*a* is released from the engaging gap part 1*a* to release the lock of the open/close door 30.

Figure 12:
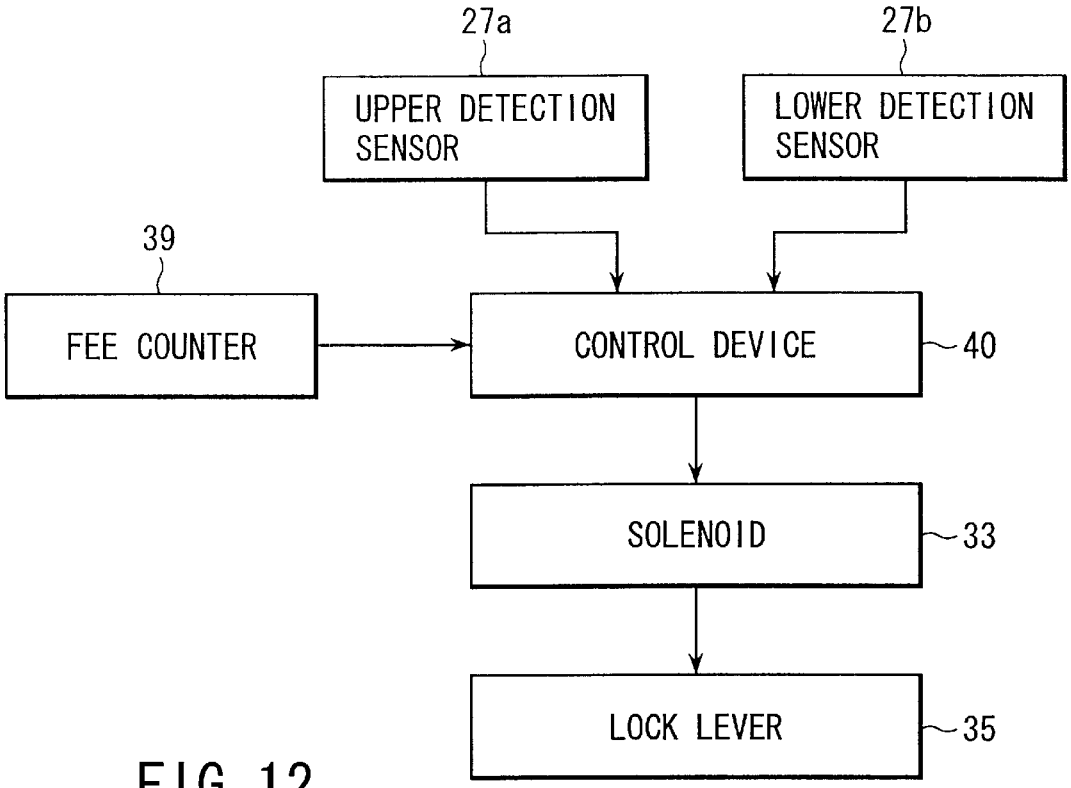
FIG. 12 is a block diagram showing the drive control system of the lock device.

FIG. 12 is a block diagram showing the drive control system of the reverse carrying apparatus 4.

The upper and lower detection sensors 27*a* and 27*b* are connected to a control device 40 through a signal circuit, and the control device 40 is connected to the solenoid 33 through a control circuit. The solenoid 33 is connected with the lock lever 35.

Also, the control device 40 is connected with a fee counter 39 through a signal circuit. The fee counter 39 is attached to an accounting device such as a coin controller or the like which will be explained later. The fee counter 39 counts inserted money and calculates the balance of use fee.

The control device 40 receives a money insertion signal or a no-balance signal concerning the fee, thereby to control rotation of the paired carrying rollers 24*a* to 24*c* on the reverse carry route 24.

Also, the control device 40 excites the solenoid 33 to lock the open/close door 30 when a paper sheet P is temporarily kept on the reverse carrying route 24, as will be described later.

Next, explanation will be made of double-side image forming operation with reference to FIGS. 1 to 9.

When forming images on both sides, the surface of the photosensitive drum 6 is charged by the charger 7 at first, and imaging light 8 is irradiated on the surface of the charged photosensitive drum 6, so that an electrostatic latent image corresponding to an original document image is formed on the surface of the charged photosensitive drum 6. This electrostatic latent image is sent to the developing device 9 by rotation of the photosensitive drum 6 and is supplied with magnetic toner as a developing agent from the developing device 9, to form a magnetic toner image.

Figure 3:
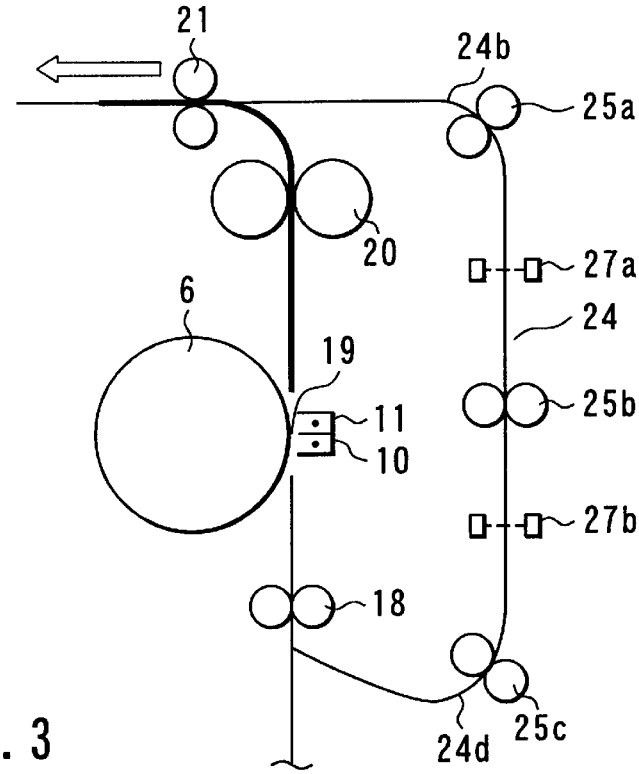
FIG. 3 is a view showing a state in which a paper sheet is being fed out from the image transfer section with an image transferred thereto.

At this time, a paper sheet P is supplied by rotation of the sheet feed roller 14 and is clamped and carried by the paired carrying rollers 17. This paper sheet P is aligned by the paired resist rollers 18 and is thereafter supplied to the image transfer section 19 between the photosensitive drum 6 and the transfer device 10. Here, the magnetic toner image on the photosensitive drum 6 is transferred to the paper sheet P. The paper sheet P on which the magnetic toner image has been transferred is separated from the photo-sensitive drum 6 and carried by the operation of the separator 11. As shown in FIG. 3, this paper sheet is then supplied to the paired fixing rollers 20 where the transferred toner image is fixed to the paper sheet P and is fed out toward the discharge tray 22.

Figure 4:
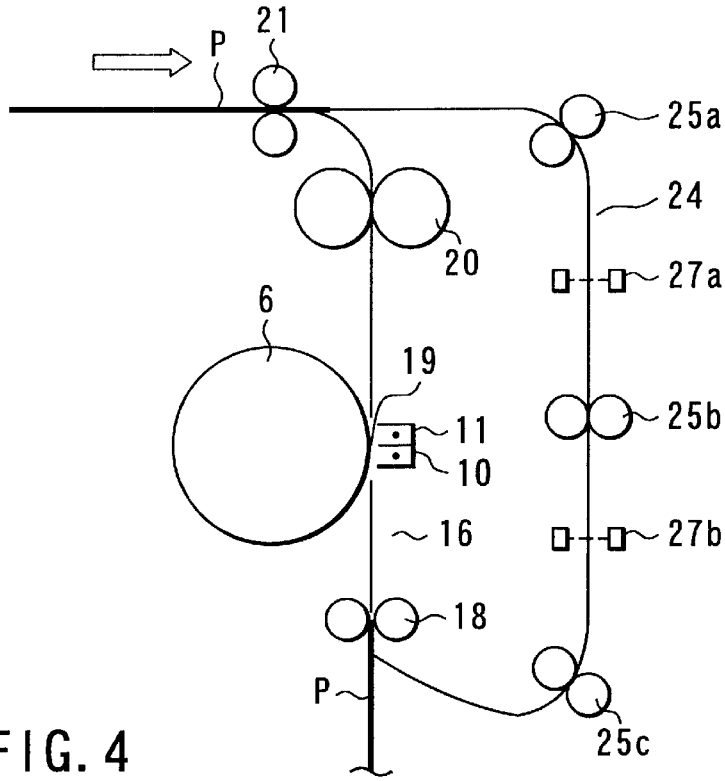
FIG. 4 is a view showing a state in which the paper sheet fed out from the image transfer section is being fed in the reverse direction, and a following paper sheet is being fed into the image transfer section.
Figure 5:
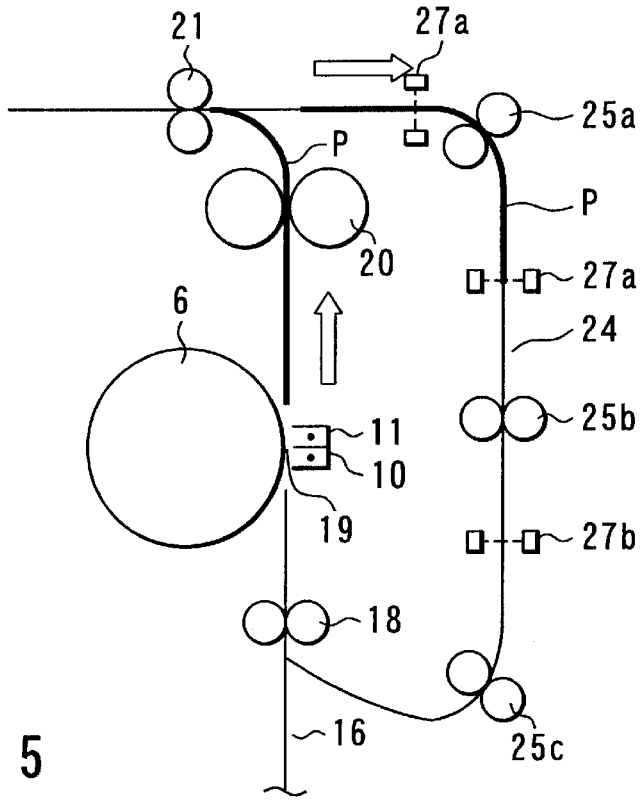
FIG. 5 is a view showing a state in which the paper sheet fed in the reverse direction is being fed into a reverse carrying route, and a following paper sheet is being fed out from the image transfer section with an image transferred thereto.
Figure 6:
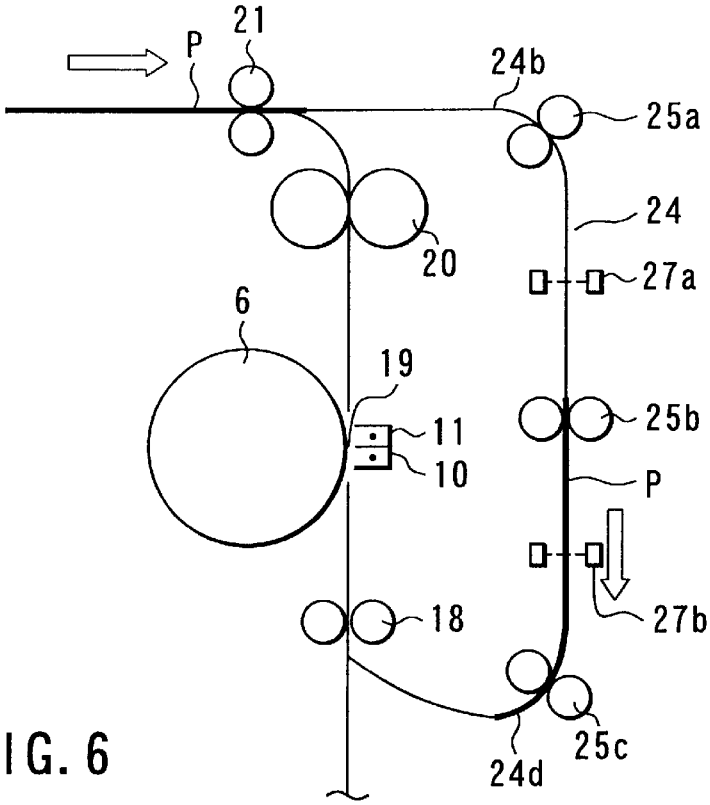
FIG. 6 is a view showing a state in which the paper sheet fed into the reverse carrying route is being carried, and the following paper sheet is being fed in the reverse direction.
Figure 7:
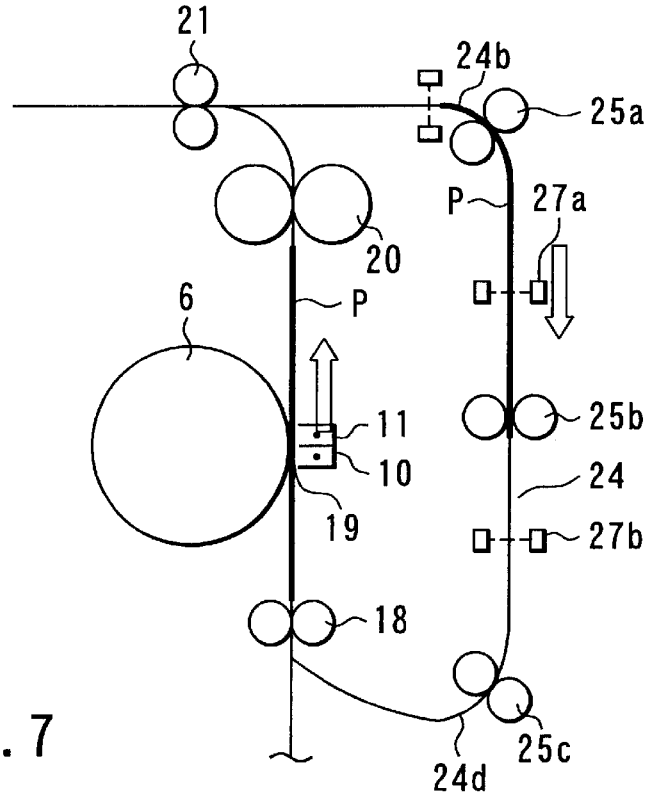
FIG. 7 is a view showing a state in which an image is being transferred to the back surface of the paper sheet fed out from the reverse carrying route, and the following paper sheet is being fed into the reverse carrying route and carried.

After the paper sheet P is fed by a predetermined amount, the paper sheet P is fed in the reverse direction, as shown in FIG. 4, and a following paper sheet P is carried along the feed carrying route 16. Subsequently, as shown in FIG. 5, the preceding paper sheet P is carried out along the reverse carrying route 24, and a toner image on the photosensitive drum 6 is transferred to the following paper sheet P which is then fed out. After the following paper sheet P is fed by a predetermined amount, it is also fed in the reverse direction as shown in FIG. 6 while the preceding paper sheet P is also carried continuously along the reverse carrying route 24. Thereafter, the preceding paper sheet P is fed into the image transfer section 19, reversed as shown in FIG. 7, and a toner image is transferred to the back surface thereof. The following paper sheet P is carried along the reverse carrying route 24.

Figure 8:
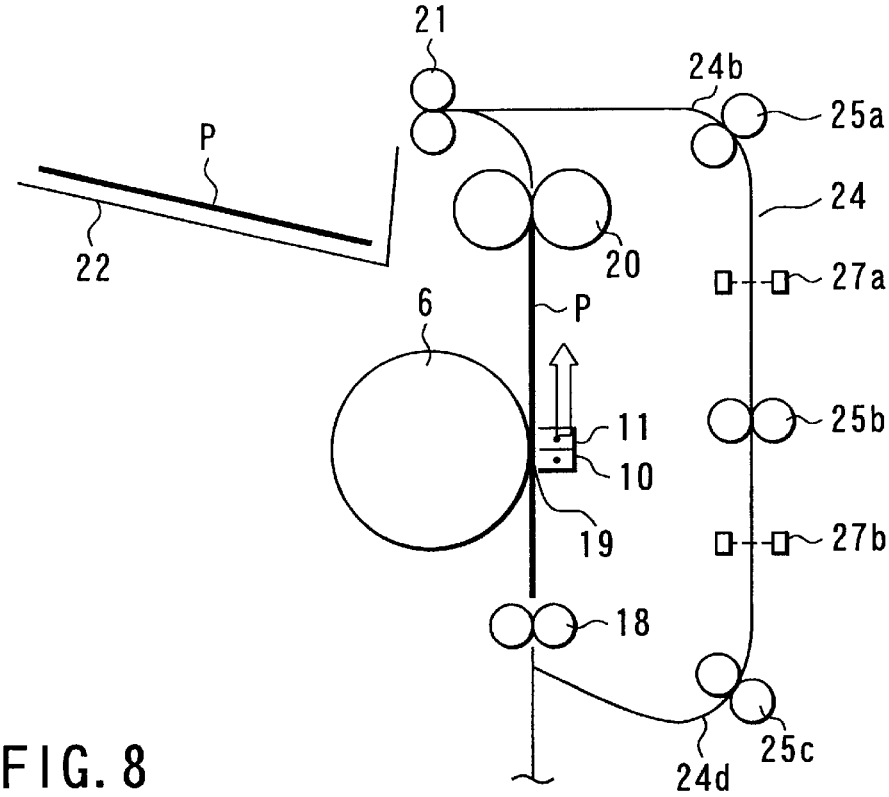
FIG. 8 is a view showing a state in which the paper sheet with an image formed on its back surface is being discharged onto a sheet discharge tray, and an image is being transferred to the back surface of the following paper sheet and carried.
Figure 9:
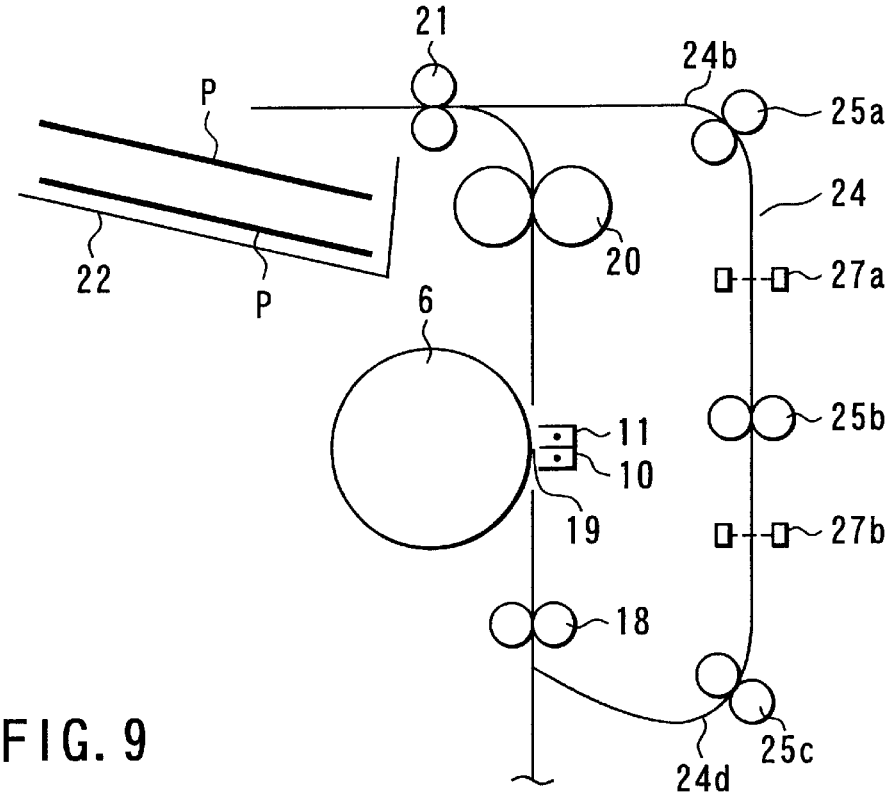
FIG. 9 is a view showing a state in which the following paper sheet with an image formed on its back surface is discharged onto the sheet discharge tray.

The preceding paper sheet P with a toner image transferred to its back surface is discharged on the discharge tray 22, as shown in FIG. 8. At this time, the following paper sheet P reversed is fed to the image transfer section 19, and a toner image is transferred to its back surface. Thereafter, the following paper sheet P is fed as shown in FIG. 9, and is carried out onto the discharge tray 22.

Meanwhile, there is a case of using the above-described stack-less ADU attached with an accounting device such as a coin controller. For example, if data of four pages should be printed on both surfaces of two paper sheets by an electrophotographic copying machine, there is a case that inserted money runs short at the time point when printing of the first, second, and fourth pages are finished. In this case, the paper sheet is directly discharged without printing the third page to be printed or kept on the reverse carrying route 24.

However, it will be unkind to the user to discharge the paper sheets P without printing the third page.

Figure 13:
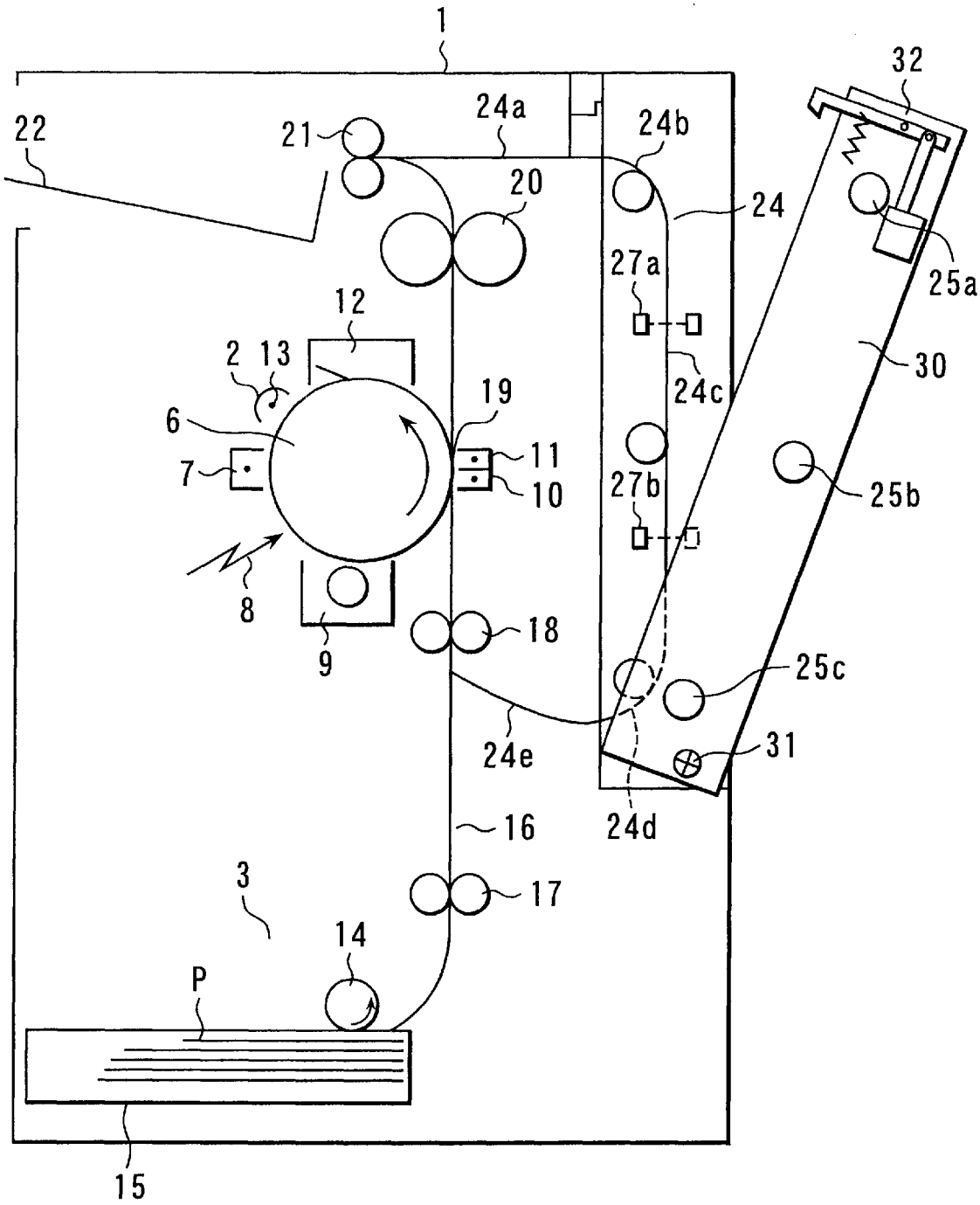
FIG. 13 is a view showing a state in which the open/close door is opened.

Otherwise, if the paper sheet P is kept on the reverse carrying route 24, the open/close door 30 is opened as shown in FIG. 13 and the reverse carrying route 24 is also opened. Then, the paired carrying rollers 25*a*, 25*b*, and 25*c* are parted, so the paper sheet P falls.

Hence, in the present invention, if the inserted money runs short at the time point when printing is finished with respect to the first, second, and fourth pages and a paper sheet P is kept on the reverse carrying route 24, the open/close door 30 is locked and inhibited from opening.

That is, if a paper sheet P is kept in the middle of the reverse carrying route 24, the paper sheet P is detected by the detection sensor 27*a*. A detection signal thereof is transmitted to the control device 40. Upon transmission of the detection signal, the control device 40 excites the solenoid 33. Upon this excitation, the operation lever 34 is moved upward thereby pushing up the lock lever 35. In this manner, as shown in FIG. 10, the lock lever 35 is rotated downward against the pressing force of the spring member 38 about the support shaft 36, so that its hook part 35*a* is engaged with the engaging gap part 1*a*. The open/close door 30 is locked by this engagement, and cannot be opened even if an operator attempts to open it.

Accordingly, the paper sheet P kept on the route does not fall through the open/close door 30, and thus, paper sheets P are prevented from being soiled as in a conventional apparatus.

Figure 11:
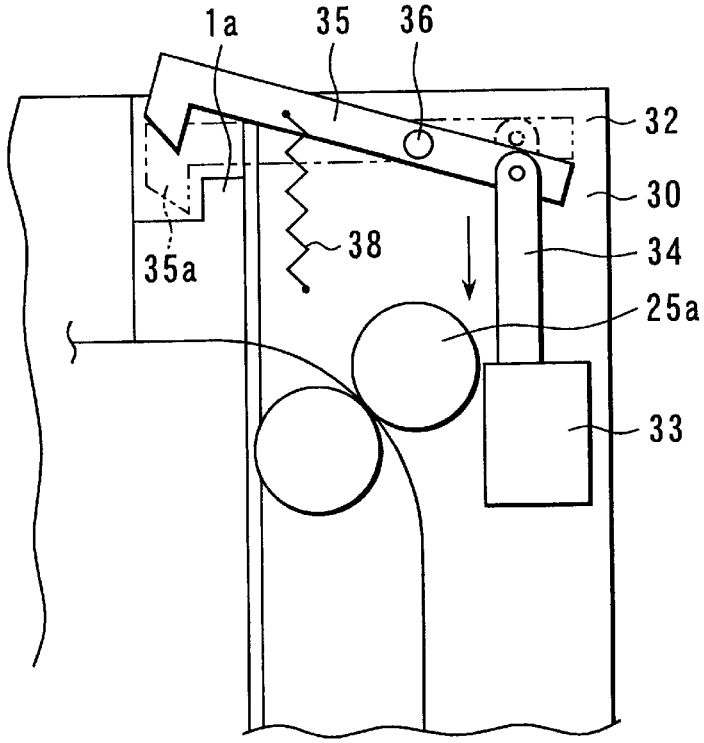
FIG. 11 is a view showing a state in which a lock of the open/close door is released.

When the paper sheet P once kept in the middle of the reverse carrying route 24 is fed out and is not detected any more by the detection sensor 27*a*, the solenoid 33 is turned off by the control device 40. As a result, the lock lever 35 is pushed up by the spring member 38, as shown in FIG. 11, so that its hook part 35*a* is released from the engaging gap part 1*a* thereby release the lock.

Figure 14:
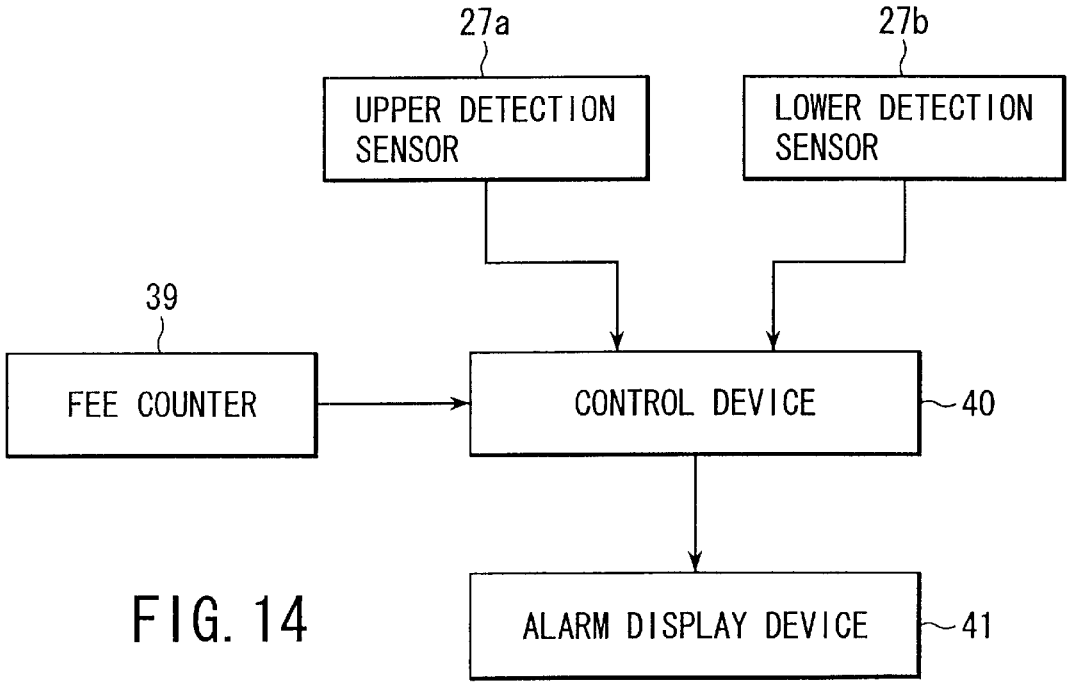
FIG. 14 is a block diagram showing the control system of a warning display device as a second embodiment of the present invention.

FIG. 14 shows a second embodiment of the present invention.

Explanation of the same parts as those shown in FIG. 12 will be denoted by the same references, and explanation thereof will be omitted herefrom.

In the first embodiment described above, the open/close door 30 is locked by the lock device 32. In the second embodiment, however, a warning display device 41 is connected to the control device 40 through a control circuit.

In the second embodiment, a paper sheet P is detected by an upper or lower detection sensor 27*a* or 27*b*, and detection information thereof is supplied to the control device 40. The control device 40 then controls the warning display device 41 to display an alarm indication that the open/close door 30 may not be opened. Thus, an operator can see the warning and refrain from opening the open/close door 30.

Accordingly, in the second embodiment, it is possible to prevent paper sheets P kept on the reverse carrying route 24 from falling down through an opened open/close door 30 like the first embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A carrying apparatus comprising:

a carrying device for carrying an object to be carried, along a carrying route;

a control device for temporarily stopping and holding the object carried by the carrying device, on the carrying route, if necessary;

an open/close door provided in the carrying device, for opening/closing the carrying route; and a limiter device for limiting opening of the open/close door, based on detection of the object by a detection device, wherein the carrying device has paired carrying rollers for clamping and carrying the object; and wherein the paired carrying rollers are brought into contact with each other and separated from each other in accordance with the opening/closing operation of the open/close door.

2. The carrying apparatus according to claim 1, wherein the detection device is a detection sensor for optically detecting the object.

3. A carrying apparatus according to claim 1, wherein said control device temporarily stops the object on the carrying route based on a shortage of a charge.

4. A carrying apparatus comprising:

a carrying device for carrying an object to be carried, along a carrying route;

a control device for temporarily stopping and holding the object carried by the carrying device, on the carrying route, if necessary;

an open/close door provided in the carrying device, for opening/closing the carrying route; and a warning display device for displaying an alarm indication for inhibiting opening of the carrying route, wherein the carrying device has a pair of carrying rollers for clamping and carrying said object; and wherein the pair of carrying rollers are brought into contact with each other and separated from each other in accordance with the opening/closing operation of the open/close door.

5. A carrying apparatus according to claim 4, wherein said control device temporarily stops the object on the carrying route based on a shortage of a charge.

6. An image forming apparatus comprising:

an image forming device for forming an image on an image carrier;

a transfer device for transferring the image formed by the image forming device, to an object to which the image should be transferred;

a reverse carrying device for carrying the object having a surface to which the image has been transferred, along a reverse carrying route, thereby to reverse and feed the object again to the transfer device, and to transfer an image on another surface of the object;

a control device for temporarily stopping and holding the object carried by the reverse carrying device, on the carrying route, if necessary;

an open/close door provided in the reverse carrying device, for opening/closing the carrying route;

a detection device for detecting the object held on the reverse carrying route; and a limiter device for limiting opening of the open/close door, based on detection of the object by the detection device, wherein the reverse carrying device has paired carrying rollers for clamping and carrying the object; and wherein the paired carrying rollers are brought into contact with each other and separated from each other in accordance with opening/closing operation of the open/close door.

7. The image forming apparatus according to claim 6, wherein the detection device is a detection sensor for optically detecting the object.

8. An image forming apparatus according to claim 6, wherein said control device temporarily stops the object on the carrying route based on a shortage of a charge.

9. An image forming apparatus comprising:

an image forming device for forming an image on an image carrier;

a transfer device for transferring the image formed by the image forming device, to an object to which the image should be transferred;

a reverse carrying device for carrying the object having a surface to which the image has been transferred, along a reverse carrying route, thereby to reverse and feed the object again to the transfer device, and to transfer an image on another surface of the object;

a control device for temporarily stopping and holding the object carried by the reverse carrying device, on the carrying route, if necessary;

an open/close door provided in the reverse carrying device, for opening/closing the carrying route;

a detection device for detecting the object held on the reverse carrying route; and a warning display device for displaying an alarm indication for inhibiting opening of the carrying route, based on detection of the object by the detection device, wherein the reverse carrying device has a pair of carrying rollers for clamping and carrying said object; and wherein the pair of carrying rollers are brought into contact with each other and separated from each other in accordance with the opening/closing operation of the open/close door.

10. An image forming apparatus according to claim 9, wherein said control device temporarily stops the object on the carrying route based on a shortage of a charge.

* * * * *